United States Patent [19]

Steelman

[11] 4,239,518

[45] Dec. 16, 1980

[54] REFRIGERATED CASE WITH MOVABLE FAN PANEL

[75] Inventor: Melvin W. Steelman, Leesburg, Fla.

[73] Assignee: Tyler Refrigeration Corporation, Niles, Mich.

[21] Appl. No.: 47,869

[22] Filed: Jun. 12, 1979

[51] Int. Cl.[3] ..... F25D 19/00; F25D 21/10

[52] U.S. Cl. ..... 62/449; 62/282

[58] Field of Search ..... 62/448, 449, 450, 282

[56] References Cited

U.S. PATENT DOCUMENTS

| | | | |
|---|---|---|---|
| 2,433,655 | 12/1947 | DiZoppola | 62/449 X |
| 2,496,492 | 2/1950 | Prosek | 62/449 |
| 2,525,868 | 10/1950 | Corhandis | 62/449 |
| 3,131,551 | 5/1964 | Ross | 62/449 X |
| 3,937,033 | 2/1976 | Beckwith et al. | 62/282 |
| 4,006,606 | 2/1977 | Underdue | 62/449 |
| 4,072,488 | 2/1978 | Johnston | 62/282 |

*Primary Examiner*—Lloyd L. King

*Attorney, Agent, or Firm*—LeBlanc, Nolan, Shur & Nies

[57] ABSTRACT

A refrigerator having a storage area for holding and displaying goods to be refrigerated including means for defrosting the coils in the refrigeration system by exposing a portion of the system to the ambient atmosphere. An air flow path is defined in the refrigerator in conjunction with the refrigeration system to refrigerate the goods on display. A closure means which carries a portion of the system is integrated with baffle means to close at least part of the air flow when the closure means is moved to an open position. In the open position the coils are defrosted by exposure to the ambient air, while some cooler air is prevented by the baffle means from being drawn out of the refrigerator.

15 Claims, 2 Drawing Figures

REFRIGERATED CASE WITH MOVABLE FAN PANEL

BACKGROUND OF THE INVENTION

This invention relates to refrigerated cases, primarily supermarket-type display cases, using air defrost concepts. More particularly, it relates to a system wherein the cooling assembly, or a portion thereof, is exposed to the warmer ambient air in the store for defrosting.

In refrigerators, and particularly in those used in commercial establishments for storing and displaying goods for sale to customers, there is a need to defrost the coils used in the refrigeration system quickly and efficiently. It is especially advantageous that this occur without defrosting the entire refrigerator, as such defrosting could have an adverse affect on the goods being stored and displayed therein. Refrigerators heretofore have included apparatus for introducing ambient air into the refrigeration circuit which will, of course, ultimately defrost the coils. See, e.g., U.S. Pat. No. 3,403,525 (Beckwith et al.); and U.S. Pat. No. 3,648,482 (Beckwith et al.). A problem with this approach, especially in frozen food cases, is that the ambient air flowing through the (normally refrigerated) air flow conduits may cause the goods being displayed to thaw sufficiently to damage the goods. Also, in open front cases, the (normally refrigerated) primary band air curtain may be cut off allowing entry of warmer ambient air into the display/storage section. See, e.g. U.S. Pat. No. 3,850,003 (Beckwith et al) and U.S. Pat. No. 4,026,121 (Aokage et al). All these situations serve to increase the load on the refrigeration unit in bringing the refrigerator back to its normal cooling/freezing temperature.

Approaches to overcome this problem have included changing the flow paths within the refrigeration system so that the ambient air introduced will not pass through portions of the refrigerator adjacent the goods being displayed. See, e.g., U.S. Pat. No. 3,082,612 (Beckwith). In addition, there have been apparatus including door means and cooling coils which are movable out of the flow path of the air and exposed in a way that ambient air being drawn through the coils will not pass through the refrigeration unit. An example of this type of refrigerator is shown in U.S. Pat. No. 2,433,655 (di Zoppola). The di Zoppola device relates to a low temperature cabinet having a hinged door along the top of the cabinet with the coils and fan secured thereto. When it is desired to defrost the coils, the door is pivoted out of the refrigeration cavity to a position where it is readily exposed to the atmosphere for drawing ambient air through the coils to defrost them. To keep the goods within the refrigerator from being exposed to the ambient atmosphere, a separate temporary cover or door is placed across the opening when the door containing the coils and fan is opened during defrost.

Another example of approaches to overcome the defrosting problem is shown in U.S. Pat. No. 2,525,868 to Corhanidis which discloses a refrigeration system having coils adapted to be defrosted by ambient air when a hinged door to the refrigeration unit is open. In this device, a series of shutters are used to change the flow path within the refrigerator so that the ambient air is not drawn into the cavity supporting the refrigerator goods during the defrosting operation. The Corhanidis device however, is one which is relatively complex in operation requiring a sophisticated system interacting with the door to change the flow path.

It is an object of the subject invention to overcome the difficulties in defrosting refrigerators, particularly those used in commercial establishments, which have characterized the refrigerators heretofore.

It is also an object to more efficiently withdraw the coils and fan used in refrigeration systems from the flow path of the refrigerator case and expose this apparatus to the surrounding atmosphere where the ambient air can readily be drawn through the coils without adversely affecting the goods being stored in the refrigerator.

It is another object to provide a system which automatically moves a door having a fan and coil attached thereto into an open position where it is exposed to the ambient air for defrosting the coils without unduly raising the temperature of the cabinet during the defrosting process.

It is still another object to automatically close the air flow path to the plenum chamber normally occupied by the coils and fan when they are moved out of the plenum chamber for defrosting, to thereby prevent the cold air from being drawn out of the refrigeration system during the defrosting process.

It is still a further object to be able to readily expose the fan and coils of the refrigeration unit so that regular maintenance or other repair tasks can be easily accomplished.

SUMMARY OF THE INVENTION

The invention relates to a refrigerator having a storage area for storing and displaying goods to be refrigerated and including a flow path for air defined in at least a portion of the refrigerator for cooling the goods being displayed. Within the flow path there is a plenum chamber occupied by cooling coils and a fan for drawing the air in the flow path through the coils for cooling and returning the cooled air to the remainder of the flow path for refrigerating stored goods. The fan and cooling coils are attached to a door on the top of the refrigerator and integrated with a baffle means such that when the door is moved to an open position exposing the coils to the ambient air, the baffle automatically closes off the inlet to the plenum chamber. A motor and linkage system is provided on the top of the refrigerator adjacent the door for moving the door between the open and closed position upon actuation of the motor. In the open position, the fan can be operated to draw the ambient air through the coils for defrosting the coils without drawing any of the air from the remainder of the flow path in the refrigerator. In addition, in the open position the fan, coils and other elements of the refrigeration system are readily exposed for routine maintenance operations and other repair jobs which may be required.

DESCRIPTION OF THE PREFERRED EMBODIMENT

Figure 1:
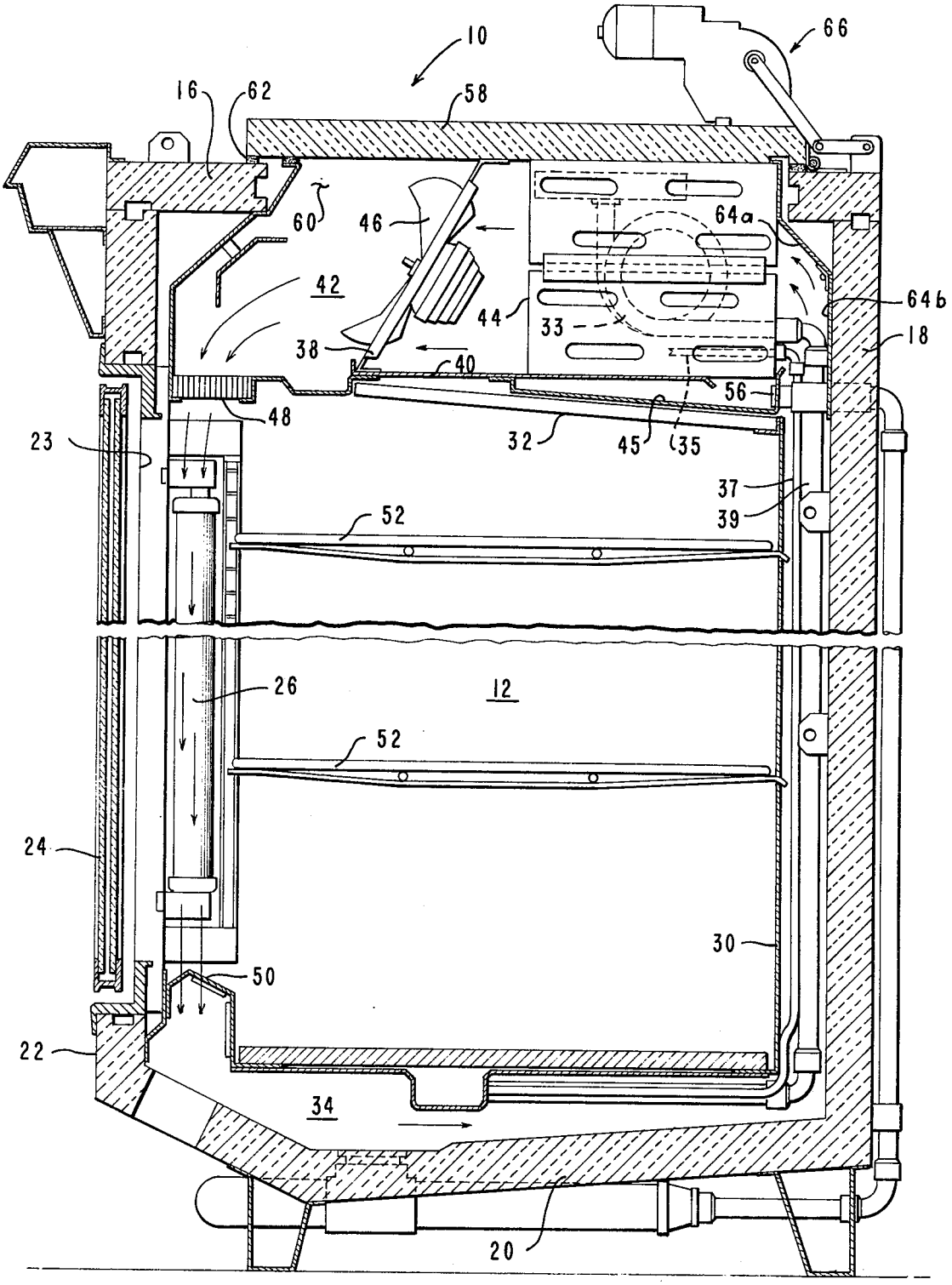
FIG. 1 is a side sectional view of a refrigerated cabinet incorporating the panel mounted fan and cooling assembly of this invention.

FIG. 1 shows an upright refrigerator 10 of the type used in commercial establishments, such as supermarkets and the like. The refrigeration includes a storage/-display section 12 for carrying and displaying goods requiring refrigeration or freezing. As shown, the refrigerator 10 generally includes an insulated top portion 16, an insulated rear portion 18, an insulated bottom portion 20 and an insulated front portion 22. Front portion 22 includes an access opening 23 and an access opening closure means, such as a sliding glass door 24. The door 24 provides access to refrigerated products stored in display section 12. One or more fluorescent tubes 26 may be located on the side walls of the cabinet to provide light for the display section interior.

The display section 12 is defined by a bottom tray 28, a rear wall 30, and a top cover 32. The front portion of display section 12 is open coincident with access opening 23 in the refrigerator outer casing.

The top of display section 12 is spaced from top portion 16 of the outer refrigerator cabinet to define therebetween a plenum chamber 42. An air outlet or discharge grill 48 is located in the bottom portion of the plenum chamber above and across substantially the entire length of access opening 23. An air inlet or return grill 50 is located below and across substantially the entire length of access opening 23. The rear and bottom members of the display section 12 are spaced from the corresponding rear and bottom portions of the outer refrigerator cabinet to define therebetween an air flow path conduit or duct, generally designated 34. Duct 34 provides a substantially unobstructed air flow path between air return 50 and the upstream or high side of plenum chamber 42.

Cooling coils 44 are located in plenum chamber 42 for cooling air passing through the plenum chamber 42. Flexible hoses 33, 35 connect evaporator or cooling coils 44 to rigid conduits 37, 39, respectively; the latter in turn are connected in known manner to main condensed refrigerant supply and expanded refrigerant return lines. In this way, cooling coils 44 are supplied with condensed liquid refrigerant from a main remote source, which is expanded in coils 44, and returned to the main system for recycling, as is well known to one skilled in the pertinent art.

One or more fans 46 are mounted to a baffle plate 38 in plenum chamber 42 to act as a propelling means for the air flow. Fans 46 draw air into air return 50, through return duct 34, through and over cooling coils 44, out discharge grill 48 and across opening 23 in the form of a refrigerated protective air curtain back to inlet 50.

One or more shelves 52 may be mounted in the display section 12 in any suitable manner for supporting products for display. The display section 12 (and the products stored therein) are cooled by the low temperature air flowing through the duct 34 because the display section 12 is not temperature insulated from the flow of air through conduit 34. In addition, a portion of the air comprising the air curtain flowing from the discharge grill 48 to the return aperture 50 will be dispersed into the display section 12 to supplement the cooling effects from duct 34 and plenum chamber 42.

The top 32 of display section 12 is slightly canted below the horizontal toward the rear beneath the cooling coils 44 to form a tray 45 for receiving the condensate formed on the cooling coils. A drain pipe 56 is advantageously connected to the rear face 47 at the low end of the tray to drain condensate from the tray 45 to some point exterior of the refrigerator.

A hinged panel 58 is secured to the top portion 16 of the outer cabinet, advantageously adjacent the rear insulated wall 18. In its closed position (FIG. 1), panel 58 covers an opening 60 in top portion 16. Panel 58 is advantageously somewhat larger than opening 60 so that the outer edges of the panel rest on the edge portions of top 16 defining the periphery of opening 60. A seal 62, made of rubber or plastic, for example, is fixed either to the top portion 16 around the edge of opening 60 or to the periphery of the inner face of panel 58. Seal 62 provides a seal between panel 58 and case top 16 to prevent the escape of refrigerated air into the ambient atmosphere.

Both the fans 46 and the cooling coils 44 are attached to the underside of the panel 58 such that when the panel is moved to an open position (FIG. 2), the fans 46 and cooling coils 44 will be moved with the panel and exposed to the ambient store atmosphere. One end of baffle plate 38 is mounted to the inner face of panel 58; the other end is fixed to a member 40, which may be advantageously fixed to and extends forwardly from the bottom of cooling coil units 44. Side panels (not shown) may also be provided to form a substantially enclosed housing for fans 46 and coils 44. By such arrangement, substantially the entire volume of air drawn by fans 46 is directed to flow through coils 44.

Figure 2:
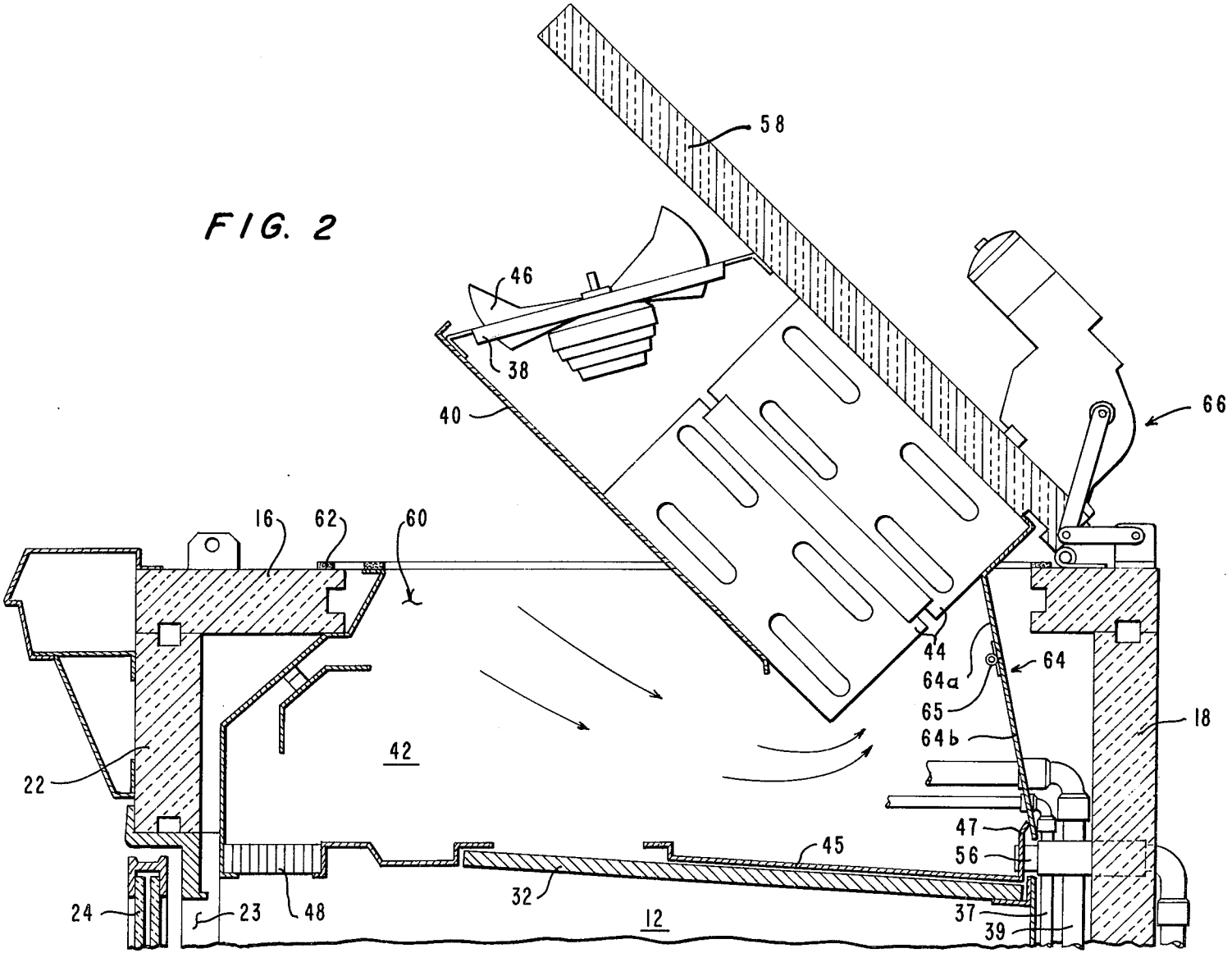
FIG. 2 is an expanded view of the upper portion of the refrigerated cabinet of FIG. 1 with the top in its open position.

A baffle member, generally designated 64, may advantageously comprise a first plate **64*a* fixed to panel 58, in any suitable manner, for movement therewith; a second plate 64*b* is coupled to the free end of plate 64*a* through, for example, a spring loaded hinge 65 which normally biases the plates 64*a* and 64*b* toward their aligned positions, as shown in FIG. 2. When panel 58 is in its closed position, plate 64*b* is pushed against rear wall 18 and is forced into the position shown in FIG. 1. In its latter position, baffle 64 guides air entering plenum chamber 42 from duct 34 toward and through the upstream end of cooling coil units 44. In its former position, baffle 64 closes off communication between plenum chamber 42 and duct 34 to prevent refrigerated air from being drawn out of duct 34** during a defrost cycle, as explained further below.

In an alternate arrangement, the baffle member may be stamped from a single piece of flexible material, e.g., spring steel, having the shape of baffle 64 as shown in FIG. 1. When panel 58 is raised into its open position, the one-piece baffle member resiliently butts up against rear face 47 with sufficient give to elastically deform without plastically deforming or breaking.

A motor driven linkage system 66 is incorporated on the top portion 16 of the refrigerator 10 for moving the panel 58 between the open and closed positions. The motor driven linkage is advantageously operated at the start of a defrost cycle, for example, to raise panel 58 into its open position (FIG. 2). This may be done manually or, preferably, automatically as part of a preprogrammed, timed refrigeration/defrost operation. A manual override may be provided to allow the panel to be raised for access to and maintenance of the fans 46 and coils 44. Simultaneously with movement of panel 58 to the open position, the baffle 64 closes off the inlet opening to the plenum chamber 42 from the duct 34. At the end of the defrost cycle, the motor is operated in reverse to return panel 58 to its closed position. At the same time, baffle 64 moves back against rear wall 18 and communication between duct 34 and plenum chamber 42 is resumed.

In the panel-open position during the defrost cycle, refrigerant flow to the cooling coils is shut off and the fans 46 are operated to draw warm ambient air from the store, through the plenum chamber 42 into the coils 44; the air is exhausted upwardly outwardly of the case 10 downstream of the fans 46. The warm ambient air passing through coils 44 defrosts them; condensate from the melting ice drops into the tray 45 and is directed through the exterior drainpipe 56 to a drain located at a position remote from the refrigerator. The bottom member 40 and side panels (not shown) assist in channeling the melting ice into tray 45.

As noted above, in the panel-open position, baffle 64 closes off communication between plenum chamber 42 and return duct 34. Therefore cold air remaining in duct 34 at the start of a defrost cycle will not be drawn out by the operation of fans 46. The cold air in duct 34 will tend to remain there to help keep display section 12 cold during the defrost cycle even though the normal flow of refrigerated air has been cut off. This has at least two disadvantages: (1) stored food products are kept relatively cold during the defrost cycle, and (2) less energy is required to bring the temperature of the display section back down to its normal operating temperature when the defrost cycle is ended and the refrigeration cycle is resumed.

From the foregoing description, it can be seen that there are many advantages in energy saving and efficiency gained from the system described. The invention described here may be embodied in other specific forms without departing from the spirit or essential characteristics thereof. The embodiment described above is therefore to be considered in all respects as illustrative and not restrictive, the scope of the invention being indicated by the hereafter appended claims rather than by the foregoing description, and all changes which come within the meaning and range of equivalency of the claims are therefore intended to be embraced therein.

What is claimed is:

1. A refrigerated case, comprising:

an outer cabinet;

an inner cabinet spaced from said outer cabinet;

air flow duct means for conveying a flowing airstream around at least a substantial portion of the exterior of the inner cabinet;

a plenum chamber between said inner and outer cabinets communicating with said duct means, said plenum chamber having a closable opening for communicating said plenum chamber with the ambient atmosphere;

closure means mounted to said case and moveable between at least closed and open positions with respect to said closable opening for closing said plenum chamber from and opening said plenum chamber to communication with the ambient atmosphere;

air circulating and cooling means mounted to said closure means, such that, in the closed position of said closure means, said air circulating and cooling means are disposed in said plenum chamber for drawing air through said cooling means and propelling said cooled air through said duct means around said inner cabinet, and, in the open position of said closure means, said air circulating and cooling means are exposed to the ambient atmosphere; and baffle means coupled with said closure means for closing off said duct means from communication with said plenum chamber when said closure means is in said open position and for opening communication between said plenum chamber and said duct means when said closure means is in said closed position.

2. A refrigerated case, according to claim 1, wherein said inner and outer cabinets each have access openings aligned with each other to allow access to the interior of said inner cabinet;

said case further comprising:

air outlet means communicating with said plenum chamber downstream of said air circulating means, said air outlet means extending across at least a substantial portion of one edge of said aligned access openings; and air inlet means extending across at least a substantial portion of an opposite edge of said aligned access openings from said one edge thereof, said duct means communicating said air inlet means with said plenum chamber;

wherein, during a normal refrigeration cycle, said closure means is in its closed position and said air circulating means draws air through said cooling means and propels the cooled air out of said outlet means, across said access openings, into said inlet means, and through said duct means back to said cooling means; and wherein, during a normal defrost cycle, said closure means is in its open position and said air circulating means draws air from the ambient atmosphere through said cooling means for defrosting same, said baffle means closing off communication between said duct means and said plenum chamber during a normal defrost cycle to substantially prevent cold air from being drawn out of said duct means by said air circulating means.

3. A refrigerated case according to claim 2, further comprising door means for selectively opening and closing said access openings, said air outlet and air inlet means being located between said door means and the interior of said inner cabinet, whereby, during a normal refrigeration cycle, an air curtain is formed across the access openings between said air outlet and air inlet means to inhibit ambient air from reaching said inner cabinet interior portion when said door means is open.

4. A refrigerated case according to claim 1 or 2, wherein said closure means further comprises a panel member hingedly secured to the top portion of said refrigerated case, and said air circulating and cooling means are secured to said panel member.

5. A refrigerated case according to claim 4 further comprising automatic moving means coupled to said panel member for moving said panel member between said open and closed positions.

6. A refrigerated case according to claim 5, wherein said baffle means includes a baffle plate secured to a portion of said panel member.

7. A refrigerated case according to claim 6, wherein said baffle means comprises a spring loaded plate secured to said panel member, said plate being biased into a closed position closing communication between said duct means and said plenum chamber when said panel member is moved to said open position.

8. A refrigerated case according to claim 1 or 2, further comprising flexible inlet and outlet lines coupling said cooling means to a main refrigerant supply source and return.

9. The refrigerator according to claim 1 or 2, further comprising a trough located in the bottom portion of said plenum chamber for receiving condensate from said cooling means, said trough being connected to an exterior drain pipe for withdrawing said condensate from said plenum chamber.

10. A refrigerated case according to claim 9, further comprising means coupled to said cooling means for channeling condensation from said cooling means to said trough.

11. An upright refrigerator having a top portion and a bottom portion, said top portion containing cooling means and air circulating means for circulating air in the refrigerator through said cooling means to cool said air prior to returning said air to said refrigerator for refrigerating the goods contained therein, said air circulating means and said cooling means being normally contained in a plenum chamber located in the top portion of said refrigerator, said plenum chamber having a discharge opening for discharging cooled air and an inlet opening for receiving air from the refrigerator, closure means movable between a closed position for substantially closing communication between said plenum chamber and the surrounding atmosphere and an open position for exposing said plenum chamber to the surrounding atmosphere, said cooling means and said air circulating means being movable with said closure means to withdraw a portion of said cooling means and said air circulating means from said plenum chamber when said closure means is moved to said open position, and baffle means for closing at least said inlet opening, said baffle means being integrated with said closure means to close said inlet opening when said closure means is moved to said open position.

12. The refrigerator according to claim 11, further comprising means for automatically moving said closure means between said open position and said closed position.

13. The refrigerator according to claim 12, wherein said baffle means comprises a spring loaded member biased toward said closed position for closing said inlet opening and integrated with said closure means for overcoming said bias to open said air inlet opening when said closure means is in said closed position.

14. The refrigerator according to claim 11 or 13, wherein said panel is movable sufficiently away from the top of said refrigerator for exposing said cooling means and said air circulating means for normal maintenance purposes.

15. The refrigerator according to claim 1, 2, 11 or 13, wherein said refrigerator includes sealing means cooperating with said closure means for sealing said plenum chamber from the surrounding ambient air when said closure means is in the closed position.

* * * * *